United States Patent [19]

Minami

[11] 4,363,483

[45] Dec. 14, 1982

[54] COMPETITIVE WATER FILLED GAME

[75] Inventor: Koichi Minami, Tokyo, Japan

[73] Assignee: Tomy Kogyo Company, Inc., Tokyo, Japan

[21] Appl. No.: 171,661

[22] Filed: Jul. 24, 1980

[30] Foreign Application Priority Data

Aug. 20, 1979 [JP] Japan ..... 54-114112[U]

[51] Int. Cl.[3] ..... A63F 7/06

[52] U.S. Cl. ..... 273/85 C; 273/1 L; 273/85 H

[58] Field of Search ..... 273/1 L, 85 H, 85 F, 273/85 C

[56] References Cited

U.S. PATENT DOCUMENTS

| | | | |
|---|---|---|---|
| 3,741,541 | 6/1973 | Crismani | 273/85 H |
| 4,032,141 | 6/1977 | Tanimura . | |
| 4,136,872 | 1/1979 | Matsumoto | 273/85 H |
| 4,142,715 | 3/1979 | Matsumoto | 273/1 L |

FOREIGN PATENT DOCUMENTS

| | | | |
|---|---|---|---|
| 510763 | 6/1955 | Italy | 273/85 F |
| 143966 | 6/1920 | United Kingdom | 273/85 H |
| 272624 | 6/1927 | United Kingdom | 273/85 H |
| 880635 | 10/1961 | United Kingdom | 273/85 F |

*Primary Examiner*—Paul E. Shapiro

*Attorney, Agent, or Firm*—K. H. Boswell; Edward D. O'Brian

[57] ABSTRACT

A game of the type wherein a transparent housing is filled with a liquid and a movable member is located in the liquid can be made competitive by utilizing a first and second circulating member each capable of ejecting a stream of liquid from a nozzle to move the movable member. The game is improved by incorporating within the interior of a housing two separate pivoting members. Each of the pivoting members is located in association with one of the nozzles and moves in response to impingement of liquid ejected from the nozzles. The ejected liquid impinges upon the surface of the pivoting members to both pivot the members and deflect the stream of liquid. The degree of pivoting and the amount of deflection are dependent on the force of ejection of the stream of liquid. The movable member can be moved within the body of the liquid either by direct contact with one of the pivoting members, by contact with currents in the liquid which are associated with movement of the pivoting members or directed by the ejected streams of liquid.

4 Claims, 3 Drawing Figures

18
10
80
70
82
16
64
90
98
72
72
92
84
66
68
74
88
60
86
46
100
52
60
100
98
56
88
14
96
54
48
78
58
76
102
42
50
22
62
44
20
26
12
108
104
110
108
106
28
110
24

COMPETITIVE WATER FILLED GAME

BACKGROUND OF THE INVENTION

A game wherein a body of liquid is located in a housing and a circulation means is utilized to move the liquid the game can be improved by incorporating two pivoting members within the housing which are caused to pivot by streams of liquid ejected from two circulating means. The pivoting members are utilized in assisting the movement of a movable member toward one of two targets.

A series of games manufactured by the assignee of this invention is directed to movement of an object within a body of liquid which is contained within a housing. These games are known under the registered trademark of "WATERFULS". The majority of these games can only be used by one person at a time. They utilized a single circulation means which is activated by the player of the game. The circulation means causes the liquid within the housing to be circulated. Circulation of the liquid moves one or more objects throughout the body of the liquid. It is an object of these games to deposit such object or objects in a scoring position or create tic-tac-toe patterns or the like.

The above "WATERFUL" type games are very stimulating and interesting. They can be used alone by one player or they can be used in a competitive manner alternating play back and forth from one player to another. This, however, requires one player to sit idle awaiting his turn. Recently this type of game has been improved by incorporating two circulating means so that two players may simultaneously utilize the game in a competitive manner. These games, however, could generally be classified as "offensive games". By this it is meant that the players are always positively trying to move an object toward a target but are never in a position to have a defensive "player or device" under their control which can be moved to actively inhibit the other player from striking his target.

Further, in all of the known WATERFUL games the movable objects within the liquid move solely under the control of currents within the liquid. No mechanical mechanisms are involved which actually contact the object to physically move it.

SUMMARY OF THE INVENTION

In view of the above it is an object of this invention to provide a game of the type having a liquid enclosed within a housing which is improved by incorporating a movable mechanical component within the housing which is capable of physically moving a movable member and/or diverting a stream of liquid issuing from a nozzle. It is a further object to improve this type of game by providing a defense type mechanism within the game such that a player not only can offensively attempt to move the movable member toward a target but can, in a defensive manner, attempt to prevent his competitor from moving the movable member toward a target.

These and other objects as will become evident from the remainder of this specification are achieved by a game having a transparent housing, a liquid located within said housing, a movable member having a specific gravity greater than the specific gravity of said liquid, said movable member located within said housing in said liquid, two circulating means for circulating said liquid within said housing, each of said circulating means capable of being independently operated such that each is capable of removing liquid from the interior of said housing and ejecting a stream of said liquid into the interior of said housing at a variable rate, each of said circulating means having a nozzle directed into the interior of said housing for ejecting said stream of liquid into the interior of said housing the improvement which comprises: said nozzles located separately within the interior of said housing and spaced apart from one another such that said stream of liquid ejected from each of said nozzles will at least each initially move independently from the stream of liquid ejected from the other of said nozzles; two pivoting members each independently pivotally mounted within the interior of said housing in said liquid and each capable of moving with respect to said housing, one of said pivoting members operatively associated with the nozzle of one of said circulating means and the other of said pivoting members operatively associated with the nozzle of the other of said circulating means, each of said pivoting members independently being capable of being pivoted with respect to said housing in response to impingement upon at least a portion of each of said pivoting members by said stream of liquid ejected from its associated nozzle each of said pivoting members capable of diverting the flow of the stream of liquid from its associated nozzle within the body of said liquid in response to movement of said pivoting member; each of said pivoting members capable of independently causing movement of said movable member within said liquid within said housing when said movable member is positioned with respect to said pivoting member causing said movement such that it can be contacted by either said pivoting member causing said movement or by a current flowing within said liquid which was caused to flow within said liquid in response to movement of said pivoting member when said pivoting member is caused to pivot by being impinged upon by said liquid ejected from its associated nozzle; two independent target means located within the interior of said housing within said liquid, each of said target means capable of serving as a target for said movable member.

The game is further improved by providing each of the target means with an opening sized to allow the movable member to pass through. An interference means is positioned in association with each of the openings in the target means. The interference means can move between a first location and a second location in response to liquid ejected from one of the nozzles and in so moving from a first location to a second location can attempt to inhibit passage of the movable member into the opening of the target means.

BRIEF DESCRIPTION OF THE DRAWINGS

This invention will be better understood when reference is made to the drawings wherein.

Figure 1:
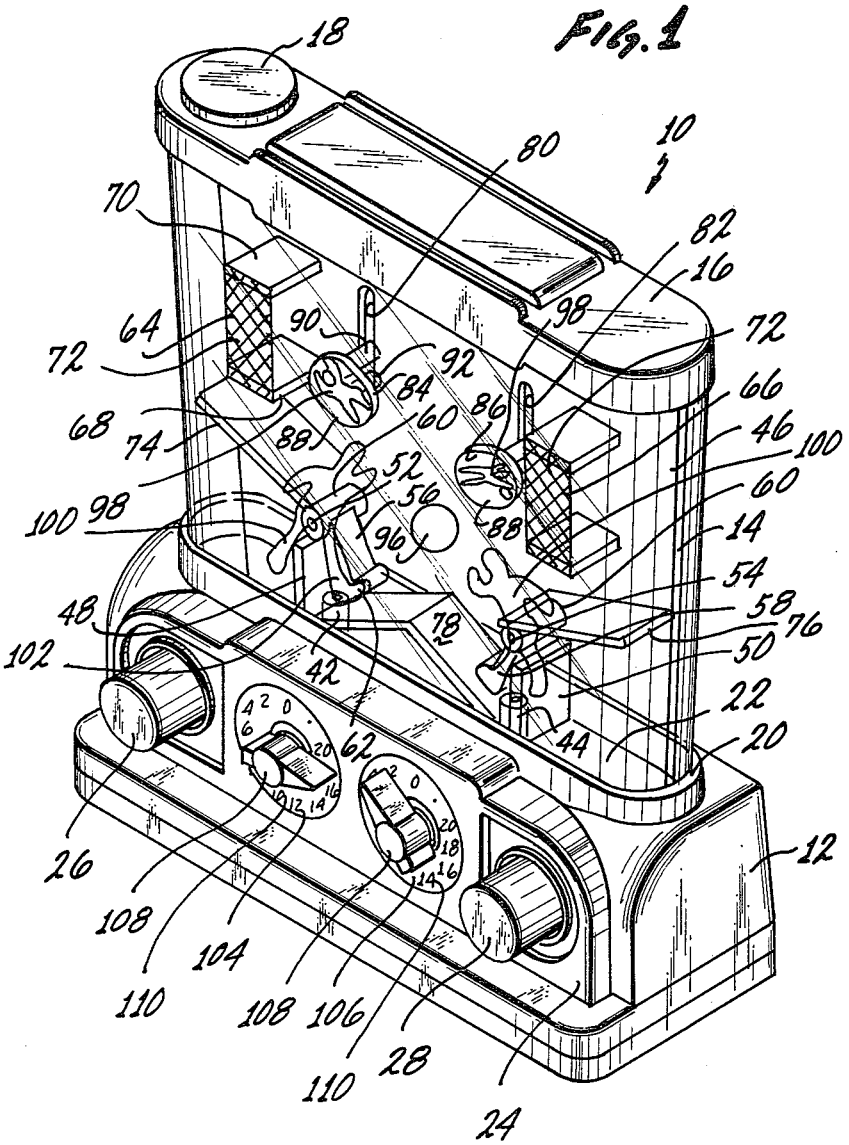
FIG. 1 is an isometric view of the game of the invention.

The invention shown in the drawings and described in this specification utilizes certain principles and/or concepts which are set forth and claimed in the claims appended to this specification. Those skilled in the toy arts will realize that these principles and/or concepts are susceptible to expression in embodiments which differ from the exact embodiments described in this specification and illustrated in the drawings. For this reason this invention is to be construed in light of the claims and is not to be construed as being limited to the exact embodiment herein depicted and described.

DETAILED DESCRIPTION

The game 10 of the invention has a base 12 with a transparent housing 14 located above the base 12. On top of the housing 14 is a cap 16 having a lid 18 thereon. The lid 18 is removable from the cap to allow introduction of a volume of liquid (not numbered), preferably water, within the housing 14. Generally sufficient liquid will be introduced into the housing 14 to fill it up to the cap 16. Once the housing 14 is filled with liquid and the cap 16 sealed with the lid 18, the volume of liquid contained within the game 10 is solely confined within the interior of the game 10.

As can be seen in the figures extending around the top of the base 12 is an oblong boss 20. The boss 20 surrounds the bottom portion of the housing 14. Located within the interior of the boss 20 is the actual bottom plate 22 of the housing 14. Except for certain circulating means hereinafter described the body of liquid used in the game 10 is totally confined within the housing 14 above bottom plate 22 and is not located within the base 12. The base 12, however, has a hollow interior (not numbered).

Projecting out of the front 24 of the base 12 is a left side push button 26 and a right side push button 28. On the inside surface of the front 24 two hollow bosses collectively identified by the numeral 30 are formed. These hollow bosses 30 serve as guides for the left and right side push buttons 26 and 28. Each of the left and right push buttons 26 and 28 have an annular flange 32 located on one of their ends which serves to retain the push buttons 26 and 28 within the hollow bosses 30 by preventing movement in a direction from the interior of the base 12 through the front 24 of the base 12.

Located within the interior of the base 12 are two bellows collectively identified by the numeral 34. The bellows 34 are formed of a flexible material and are self biased to an open position. Each of these bellows 34 are attached to one of the left or right push buttons 26 or 28 by joining the bellows 34 to the annular flanges 32. The other end of the bellows 34 are joined to couplings collectively identified by the numeral 36. Leading from the couplings 36 are left and right corrugated tubes 38 and 40. The couplings 36 and the tubes 38 and 40 are hollow and a fluid channel is formed through the tubes 38 and 40 and the couplings 36 into the hollow interior of the bellows 34.

A left side nozzle 42 and a right side nozzle 44 are joined to the corrugated tubes 38 and 40 respectively. Each of these nozzles 42 and 44 have a hole allowing them to serve as fluid passageways. The nozzles 42 and 44 project through openings spaced apart from each other (not numbered) in the bottom plate 22 of the housing 14. The nozzles 42 and 44 form a water-tight seal with the bottom plate 22. Portions of the body of liquid located within the housing 14 therefore can pass through the nozzles 42 and 44 into the tubes 38 and 40, through the couplings 36 to the interior of the bellows 34.

By depressing and releasing the left and right push buttons 26 and 28 the bellows 34 can be made to expand and contract. On contraction this will force any fluid located within the interior out of the nozzles 42 and 44 and upon expansion fluid will be drawing from the interior of housing 14 through the nozzles 42 and 44 into the interior of the bellows 34. It can thus be seen that each of the respective push buttons 26 and 28 control the flow of fluid through the respective nozzles 42 and 44.

After initially depleting the interior of the bellows 34 of air and filling them with liquid by depression of the push buttons 26 and 28 several times a volume of liquid is captured within the interior of the bellows 34. A stream of liquid can be ejected from the nozzles 42 or 44 by depressing the respective push buttons 26 and 28. The force or velocity of the ejection of this stream of liquid is dependent upon the force applied to the respective push button 26 or 28. In using the game 10 the ability to vary the force and/or the velocity of a stream of liquid being ejected out of the nozzle 42 or 44 allows a player of the game a certain degree of control of other components as hereinafter described. Because the nozzles 42 and 44 are spaced apart from one another at least initially the streams of liquid ejected from the nozzles 42 and 44 flow independently within the liquid.

Located within the interior of the housing 14 is an upright support plate 46. Support plate 46 extends near the back surface (not numbered) of the housing 14 almost across the full width of the housing 14. The support plate 46 as well as the housing 14 are formed of a transparent clear plastic material which allows one to see completely through the housing 14. The support plate 46 rests on the bottom plate 22 and extends between it and the cap 16.

Figure 2:
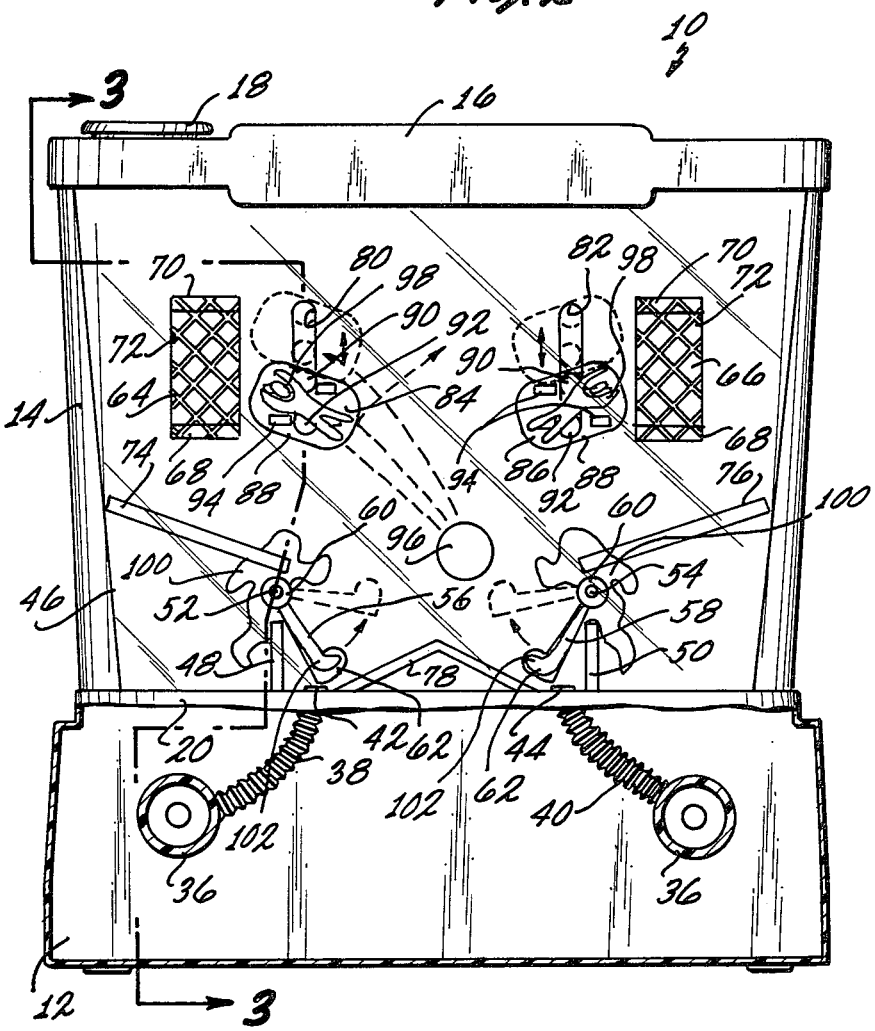
FIG. 2 is a front elevational view in partial section and including certain of the movable components of the invention shown in both solid and phantom lines in different positions.
Figure 3:
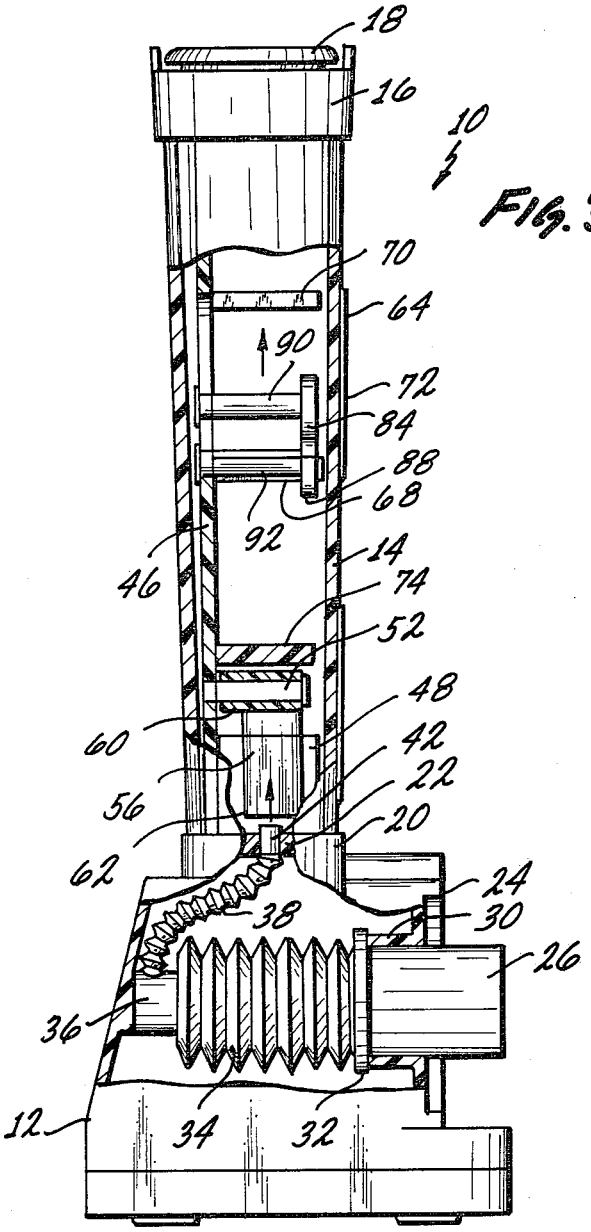
FIG. 3 is a side elevational view in partial section about the line 3—3 of FIG. 2 of the game of the invention.

As can be seen in FIGS. 1 and 2 upright baffles 48 and 50 are located one to the left side of nozzle 42 and one to the right side of nozzle 44, respectively. These baffles 48 and 50 are integrally formed with and extend from the surface of support plate 46. Also integrally formed on the surface of support plate 46 and projecting perpendicular from it are left and right side axles 52 and 54. These axles 52 and 54 are located directly over the upright baffles 48 and 50 respectively. Pivotally mounted to axles 52 and 54 are pivot members 56 and 58, respectively. The pivot members 56 and 58 each contain a bearing member collectively identified by the numeral 60 which slips over the respective axle 52 or 54 and is sized such that rotary movement about these axles 52 and 54 is possible. The elongated tongue portion 62 of both pivot members 56 and 58 is biased downwardly by gravity to a position as is depicted in FIG. 2 locating it directly over nozzle 42 or 44.

Because of the location of pivot members 56 and 58 in association with the nozzles 42 and 44 whenever a stream of liquid is ejected from the nozzle 42 or 44 this stream of liquid impinges upon a portion of the pivot members 56 or 58 causing the same to pivot about the axles 52 or 54. Furthermore, because of the placement of the pivot members 56 and 58 in association with the nozzles 42 and 44 the direction of the stream of fluid ejected from the nozzles 42 and 44 is modified depending on the exact position of the pivot members 56 and 58 with respect to the housing 14. It is evident from the figure that if the pivot members 56 and 58 were not located where they are the stream of liquid being ejected from either nozzle 42 or 44 would be free to directly infiltrate the body of liquid within the housing 14. Indeed, in prior WATERFUL games this is exactly the situation. However, since the pivot members 56 and 58 are located where they are their very presence modifies the currents which are produced within the liquid located in the housing 14.

Located above and to the left and right sides, respectively, of pivot members 56 and 58 are left and right side targets 64 and 66. These targets 64 and 66 are identical except for their placement and each is composed of a lower horizontal plate 68 and an upper horizontal plate 70 and an indicia 72 indicative of netting formed on the surface of housing 14 between the lower and upper horizontal plates 68 and 70. When viewed from the outside then it appears that each of the left and right targets 64 and 66 represents a goal-like enclosure such as a soccer goal.

Located below left and right targets 64 and 66, respectively, are obliquely slanting baffles 74 and 76. The baffles 74 and 76 are integrally formed with the support plate 46 and project from its surface. They slant down toward the pivot members 56 and 58, respectively. Projecting upwardly from bottom plate 22 in between nozzles 42 and 44 is a wedge-shaped baffle 78. Its two sides (not separately numbered) project obliquely toward each other and meet at a point. As with the other baffles described before, the wedge-shaped baffle 78 is integrally formed on and projects from the surface of support plate 46.

Left and right side grooves 80 and 82 are formed in support plate 46 in a position essentially directly above pivot members 56 and 58 and in front (with respect to the center of the housing 14) of the targets 64 and 66, respectively. The grooves 80 and 82 are elongated grooves and serve as tracks for movable pieces. These movable pieces are left interference member 84 and right interference member 86.

Each of these interference members 84 and 86 are identically constructed except for orientation of indicia on their surfaces and include an indicia support plate 88 which has two circular bosses 90 and 92 attached to it which project rearwardly. The bosses 90 and 92 fit within the grooves 80 and 82 and their ends (not numbered) are mushroomed over much like a rivet to fixedly retain them within the grooves 80 and 82. Since the bosses 90 and 92 are made of a plastic material the mushrooming of this end is easily accomplished by heat treatment.

Also projecting rearwardly from the support plate 88 are a plurality of baffles collectively identified by the numeral 94. These extend between the support plate 88 and the front surface of the support plate 46. They ride along the surface of support plate 46 to the right and left of the grooves 80 and 82, respectively. They serve two functions. The first function is in combination with the mushroom ends of bosses 90 and 92. The mushroomed ends of the bosses 90 and 92 are located on one side of the support plate 46 and the baffles 94 are located on the other side of support plate 46. This prevents forward and aft movement of the interference members 84 and 86. Secondly, the baffles 94 can be influenced by currents within the liquid. If a current strikes their underside they can be lifted upwardly causing the respective interference member 84 or 86 to which they are attached to move upwardly within its groove 80 or 82. The weight of the interference members 84 and 86 bias them downwardly in the grooves 80 and 82.

Also located within the interior of housing 14 is a movable member 96. Preferably it is shaped as a ball and depicts a ball used in a sporting contest such as a soccer game. Its density is such that it is more dense than the liquid contained within the housing 14. This causes it to sink toward the bottom plate 22 of the housing 14.

Each of the indicia support plates 88 contain an indicia 98 representing the body of a defensive player of a typical sporting event such as soccer. Additionally, an indicia 100 is located on the surface of housing 14 in conjunction with the pivot members 56 and 58. The indicia 100 is shaped as an offensive player of a sporting event such as soccer. The indicia 100 includes the torso, two arms, a head and one leg of the offensive player. An indicia 102 representing the other leg is formed on the side surface (not numbered) of pivot members 56 and 58. Thus, when the pivot members 56 and 58 pivot it appears that one of the legs of the offensive player is moving in a kicking motion.

The left and right targets 64 and 66 are sized to allow the movable member 96 to pass between the lower and upper horizontal plates 68 and 70. If the interference members 84 and 86 are located in a first location as shown in solid lines in FIG. 2 the movable member 96 is capable of passing above them and in through the front opening of the target 64 or 66. If these interference members 84 or 86 are located in a second position shown in phantom lines in FIG. 2 the movable member 96 is capable of passing under them and through the opening into the targets 64 and 66. Under the influence of either currents within the liquid or gravity the interference members 84 and 86 move back and forth between these two positions. In so moving back and forth and if correctly positioned the interference members 84 and 86 can present an obstacle to the movable member 96 preventing its entry into either of the targets 64 or 66.

The limits of travel of pivot members 56 and 58 are governed by the interaction of the tongue portion 62 with either upright baffles 48 and 50 or obliquely slanting baffles 74 and 76. When either of the pivoting members 56 or 58 are in a position where they are contacting baffles 74 or 76 they are not in positions to interfere very extensively with the streams of liquid issuing from nozzles 42 and 44. However, when they are in a position wherein they contact upright baffles 48 and 50 they do interfere extensively with the steam of liquid issuing from nozzles 42 and 44.

If one of the push buttons 26 or 28 is forcefully depressed a powerful stream of liquid will issue from the respective nozzle 42 or 44. This will strike or impinge upon pivot member 56 or 58 has turned in an arcuate manner the full extent in an upward direction the stream of liquid will then be able to strike the baffles 94 on the interference members 84 and 86 causing the same to move upwardly.

If the push buttons 26 or 28 are only depressed for a very short time or very gently, the force of the stream of liquid issuing from nozzle 42 or 44 will only be sufficient to move the pivot members 56 or 58 a portion of their limit of travel. When this happens generally the stream of liquid is reflected by the combination of upright baffle 48 or 50, pivot member 56 or 58, and wedge-shaped baffle 78 toward the center of the housing 14. It can be seen that by varying either the amount of or the velocity of the depression of the push buttons 26 and 28, a different set of currents can be generated within the body of the liquid within the housing 14 by the streams of liquid being ejected from the nozzles 42 and 44.

In play the movable member 96 is caused to descend through the liquid by gravity and either falls directly on wedge-shaped baffle 78 or is directed there by one of baffles 74 or 76. Depending on which side of the wedge-shaped baffle 78 the movable member 96 is located it will move toward one or the other of pivot members 56 or 58. The player in control of that particular pivot members 56 or 58 can then depress his push button 26 or 28 causing either direct contact of the pivot member 56 or 58 with the movable member 96 or indirect contact between currents generated by movement of the pivot members 56 and 58 with the movable member 96. In any event, the movable member 96 will move away from the pivot member 56 or 58.

If the velocity imparted to the movable member 96 is sufficient it will move upwardly and across the housing 14 toward the goal 64 or 66 which is on opposite sides of the housing 14 from the pivot member 56 or 58 imparting the motion. If the interference members 84 and 86 located in association with the target 64 or 66 toward which the movable member 96 is moving does not interfere with the movement of the movable member 96, the movable member 96 can successfully pass into and through the target 64 or 66. The other player, however, can attempt to interfere with this movement by forcefully depressing his push button 26 or 28 to cause a stream of liquid to be emitted from the nozzle 42 or 44 under his control. A forceful stream of liquid as noted above can be made to impinge upon the baffles 94 of the interference member 84 or 86 under his control, lifting that interference member. If the movable member 96 is approaching the respective target 64 and 66 toward the top portion or side of the target, the opposite player would want to do this. If the movable member 96 is approaching the target 64 or 66 near the bottom of the target, the opposite player, of course, would want his interference member 84 or 86 to remain near the bottom of its respective groove 80 or 82 and prevent entry of the movable member 96 into the lower portion or side of the respective target 64 or 66. Of course, if the movable member 96 approaches the center of the target 64 or 66 the opposite player will want to adjust the velocity of the stream of liquid being ejected from his nozzle 42 or 44 such that his respective interference member 84 or 86 only moves part way up its respective groove 80 or 82 to place his respective interference member 84 or 86 in a centralized position with respect to the target 64 or 66.

Located on front 24 of base 12 are two scoring devices 104 and 106. Each scoring device 104 and 106 has an indicator hand 108 which is rotatably mounted to the base 12. Indicia 110 imprinted in a dial-like manner around the locus of travel of the hand 108 is used to keep track of how many times each of the players of the game successfully causes the movable member 96 to pass through his opponent's target 64 or 66. The indicator hands 108 are simply moved from one indicia to the next manually each time a goal is successfully made.

I claim:

1. A game having a transparent housing, a liquid located within said housing, a movable member having a specific gravity greater than the specific gravity of said liquid, said movable member located within said housing in said liquid, two circulating means for circulating said liquid within said housing, each of said circulating means capable of being independently operated such that each is capable of removing liquid from the interior of said housing and ejecting a stream of said liquid into the interior of said housing at a variable rate, each of said circulating means having a nozzle directed into the interior of said housing for ejecting said stream of liquid into the interior of said housing the improvement which comprises:

said nozzles located separately within the interior of said housing and spaced apart from one another such that said stream of liquid ejected from each of said nozzles will at least each initially move independently from the stream of liquid ejected from the other of said nozzles;

two pivoting members each independently pivotally mounted within the interior of said housing in said liquid and each capable of moving with respect to said housing, one of said pivoting members operatively associated with the nozzle of one of said circulating means and the other of said pivoting members operatively associated with the nozzle of of the other of said circulating means, each of said pivoting members independently being capable of being pivoted with respect to said housing in response to impingement upon at least a portion of each of said pivoting members by said stream of liquid ejected from its associated nozzle, each of said pivoting members capable of diverting the flow of the stream of liquid from its associated nozzle within the body of said liquid in response to movement of said pivoting member;

each of said pivoting members capable of independently causing movement of said movable member within said liquid within said housing when said movable member is positioned with respect to said pivoting member causing said movement such that it can be contacted by either said pivoting member causing said movement or by a current flowing within said liquid which was caused to flow within said liquid in response to movement of said pivoting member when said pivoting member is caused to pivot by being impinged upon by said liquid ejected from its associated nozzle;

two independent target means located within the interior of said housing within said liquid, each of said target means capable of serving as a target for said movable member;

at least a portion of said flow of the stream of the liquid which is diverted by said pivoting members being directed toward an area located within said housing between said nozzles and said target means;

each of said target means includes a vertically oriented opening, said opening sized to allow said movable member to pass through said opening into said target means;

two interference means positioned within said housing, one of said interference means positioned in association with the opening of one of said target means and the other of said interference means positioned in association with the opening of the other of said target means, each of said interference means positioned in association with one of said nozzles such that streams of liquid passing within said body of said liquid which have been ejected through said nozzle cause said interference means associated with said nozzle to move from a first location to a second location;

each of said interference means being positioned in front of said opening in said target means with which it is associated and being capable of essentially closing off a portion of said opening in said target means with which it is associated to entry of said movable member into said opening;

said first location corresponding to positioning of said interference means with respect to said target means such that said interference means is located such that it inhibits entry of said movable member into one side of said opening, said second location corresponding to positioning of said interference means with respect to said target means such that said interference means is located such that it inhibits entry of said movable member into the other side of said opening;

said one of said target means being positioned above one of said pivoting members and said other of said target means being positioned above the other of said pivoting members and said streams of liquid being ejected from said nozzle being generally directed upwardly within said housing toward said interference means;

said housing further including two vertically oriented interference track means, one of said interference means located in one of said track means, the other of said interference means located in the other of said track means, each of said interference means biased downwardly within its respective track means by gravity from said second location to said first location;

each of said interference means including at least one baffle means, said baffle means capable of being acted upon by currents within said liquid such that currents within said liquid are capable of moving said interference means against the bias of gravity from said first location to said second location.

2. The game of claim 1 wherein:

each of said pivoting members comprises an elongated member pivotally attached at one of its ends to said housing, the other end of said elongated member biased downwardly within said housing by gravity to a position locating the other end of said elongated member in close association with said nozzle which is associated with said member;

the other end of said elongated member capable of moving arcuately within said housing in an upward direction in response to impingement upon said elongated member by a portion of said stream of said liquid ejected from said nozzle.

3. The game of claim 2 wherein:

said elongated member as it is pivoted within said housing is capable of diverting the direction of flow of said nozzle stream of said liquid ejected from said nozzle.

4. The game of claim 3 including:

an upwardly directed wedge-shaped baffle having two sides, each of the sides directed obliquely upwardly and inwardly toward each other of the sides, the lower end of each of the sides located adjacent one of said nozzles, the two sides meeting each other at a point, said wedge-shaped baffle located between said two nozzles and capable of directing the movement of said movable member toward one or the other of said nozzles when said movable member contacts said baffle and rolls down one or the other of said two sides under the influence of gravity.

* * * * *

UNITED STATES PATENT AND TRADEMARK OFFICE

CERTIFICATE OF CORRECTION

PATENT NO. : 4,363,483

DATED : DECEMBER 14, 1982

INVENTOR(S) : KOICHI MINAMI

It is certified that error appears in the above-identified patent and that said Letters Patent is hereby corrected as shown below:

Column 10, line 19, Claim 3, "said nozzle stream" should read --said stream--.

Signed and Sealed this

*Twenty-second* Day of *November 1983*

[SEAL]

*Attest:*

GERALD J. MOSSINGHOFF

*Attesting Officer*

*Commissioner of Patents and Trademarks*